US009403193B1

(12) United States Patent
Picard, Jr.

(10) Patent No.: US 9,403,193 B1
(45) Date of Patent: Aug. 2, 2016

(54) ROLLER APPARATUS

(71) Applicant: Charles A. Picard, Jr., Rockland, MA (US)

(72) Inventor: Charles A. Picard, Jr., Rockland, MA (US)

( * ) Notice: Subject to any disclaimer, the term of this patent is extended or adjusted under 35 U.S.C. 154(b) by 0 days.

(21) Appl. No.: 14/725,516

(22) Filed: May 29, 2015

(51) Int. Cl.

| | |
|---|---|
| ***B07B 1/50*** | (2006.01) |
| ***E01H 10/00*** | (2006.01) |
| ***B07B 1/04*** | (2006.01) |
| ***B07B 1/52*** | (2006.01) |
| *B07B 1/00* | (2006.01) |

(52) U.S. Cl.
CPC ... *B07B 1/50* (2013.01); *B07B 1/04* (2013.01); *B07B 1/524* (2013.01); *E01H 10/007* (2013.01); *B07B 1/005* (2013.01)

(58) Field of Classification Search
CPC ..... B07B 1/005; B07B 1/50; B07B 1/52; B07B 1/526; B07B 1/528; B07B 2201/02
USPC ..... 209/279–290
See application file for complete search history.

(56) References Cited

U.S. PATENT DOCUMENTS

| | | | | |
|---|---|---|---|---|
| 301,251 | A | 7/1884 | Mase | |
| 476,532 | A | 6/1892 | Edison | |
| 624,965 | A | 5/1899 | Oester | |
| 735,713 | A | 8/1903 | Crofoot | |
| 1,213,239 | A | 1/1917 | Noll | |
| 2,802,570 | A * | 8/1957 | Rapp | B07B 1/524 209/390 |
| 3,374,505 | A * | 3/1968 | Neitzel | D01B 1/04 19/93 |
| 3,602,404 | A * | 8/1971 | Frank | A01C 3/06 222/252 |
| 4,023,689 | A | 5/1977 | Taylor et al. | |
| 4,106,643 | A * | 8/1978 | McGehee | A01C 15/00 220/653 |
| 4,469,230 | A * | 9/1984 | Gorlitz | B07B 1/22 209/369 |
| 4,552,653 | A | 11/1985 | Sumino | |
| 4,896,835 | A | 1/1990 | Fahrenholz | |
| 4,995,773 | A | 2/1991 | Lamoureux et al. | |
| RE34,458 | E | 11/1993 | Fahrenholz | |
| 5,605,233 | A * | 2/1997 | Hauch | B07B 1/54 209/385 |
| 5,772,389 | A | 6/1998 | Feller | |
| 5,915,567 | A * | 6/1999 | Zimmermann | B07B 1/46 209/283 |
| 6,065,922 | A | 5/2000 | Kato et al. | |
| 6,257,414 | B1 | 7/2001 | Gerhardt et al. | |
| 6,325,215 | B1 * | 12/2001 | Anthony | B07B 9/00 209/21 |
| 6,382,424 | B1 | 5/2002 | Bolton et al. | |
| 6,881,022 | B2 * | 4/2005 | Feller | B60P 1/16 414/489 |
| 7,461,746 | B1 * | 12/2008 | Egge | B02C 21/02 209/268 |
| 2004/0035764 | A1 | 2/2004 | Kreft et al. | |
| 2012/0312724 | A1 * | 12/2012 | Farwick | B07B 1/528 209/369 |

* cited by examiner

*Primary Examiner* — Joseph C Rodriguez
(74) *Attorney, Agent, or Firm* — John P. McGonagle

(57) ABSTRACT

A free-standing roller apparatus for clearing screens on dispensers sitting within truck dump bodies is provided. The roller apparatus provides a hard bristle, rotating roller attached to an arm, which allows the roller to be lowered onto the dispenser screen. The roller adjusts automatically to the height of each truck.

3 Claims, 7 Drawing Sheets

ROLLER APPARATUS

BACKGROUND OF THE INVENTION

This invention relates to screening machines, and more particularly to a roller for cleaning sand and gravel screens.

Spreader/dump truck vehicles are well known in the art. Such vehicles are adapted especially for the purpose of spreading road salt and sand on winter roads as well as conventional dump truck purposes, such as transporting salt, sand and other granular materials. Trucks of this type typically contain a dispensing device that sits upon the dump body of the truck. To evenly spread road salt and sand, the granular material within the dispenser must be free of clumps and extraneous material. This is accomplished by attaching a screen, either temporarily or permanently, to the top of the dispenser, thereby providing a dispenser loaded with sifted granular material. To load the dispenser, granular material is poured onto and through the screen into the dispenser within the truck body. Clumped material as well as granular material which is thicker than a predetermined thickness is prevented from entering the dispenser.

One of the drawbacks of the above system is that the screen often becomes clogged and requires a worker to climb up onto the screen to push material through or off the screen. Because this screening and truck loading usually takes place during icy conditions, the worker is in danger of falling or sliding off the screen. Since the screen may be 13 feet or more off the ground, a worker falling off the screen is subject to substantial injury. Furthermore, having a worker walking on top of the screen may damage the screen itself.

SUMMARY OF THE INVENTION

The present invention overcomes the limitations of prior art dispenser loading systems by providing a roller apparatus adapted to clear screens on dispensers sitting within truck dump bodies. The present invention roller apparatus provides a hard bristle, rotating roller adapted to being lowered onto the dispenser screen to clear the screen of clumps and debris.

The roller apparatus is free standing and is of sufficient size to accommodate a standard or large size dump truck. The truck can be driven through the invention. The roller is attached to an arm, which allows the roller to be lowered onto the dispenser screen. The roller adjusts automatically to the height of each truck that enters the frame. The roller rotates clockwise as the driver moves forward, right to left. The roller rotates to free up material on the screen that is not usable and may cause clogs to the dispenser.

These together with other objects of the invention, along with various features of novelty, which characterize the invention, are pointed out with particularity in the claims annexed hereto and forming a part of the disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
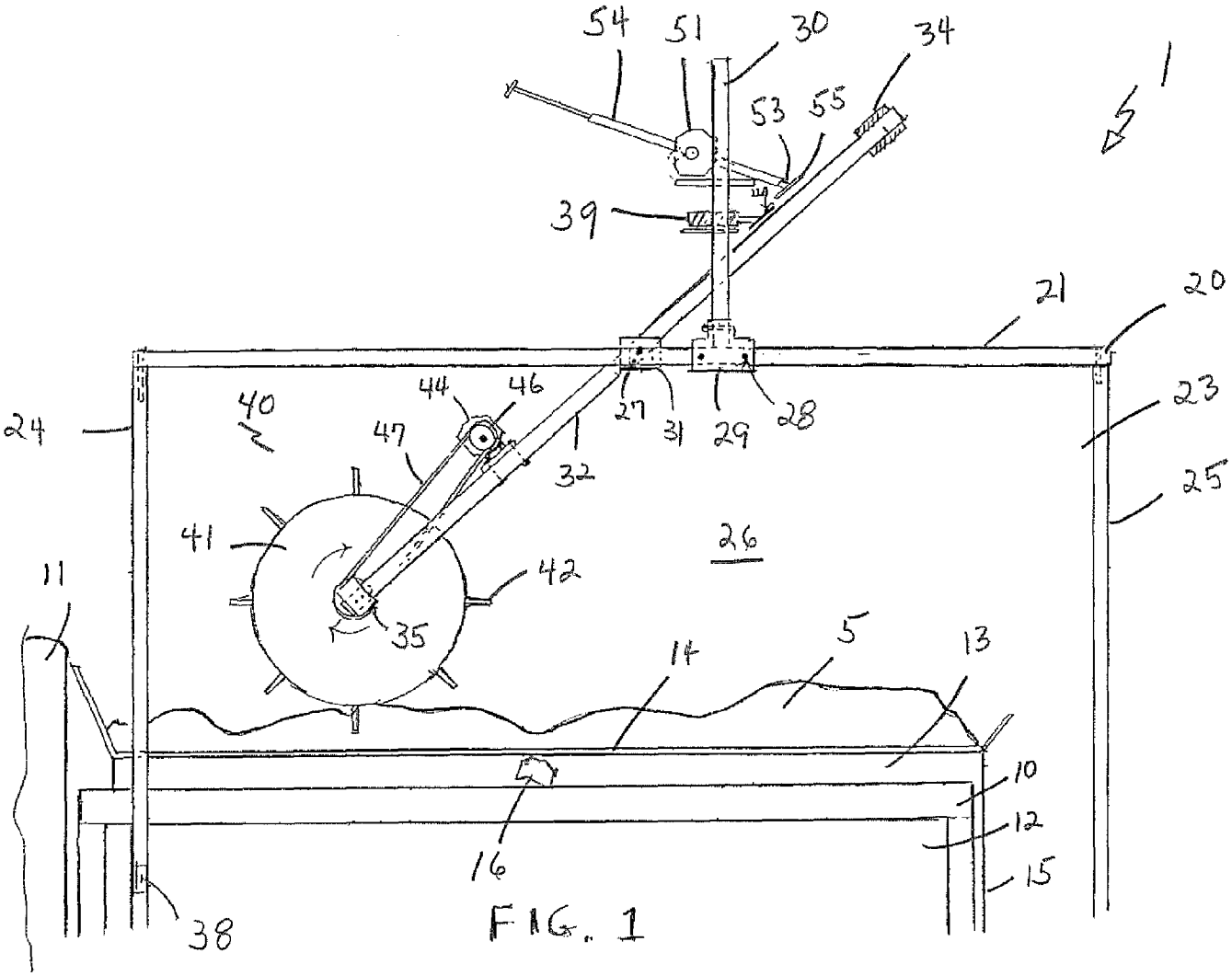
FIG. 1 is a side view of the invention with a truck within the frame interior.
Figure 2:
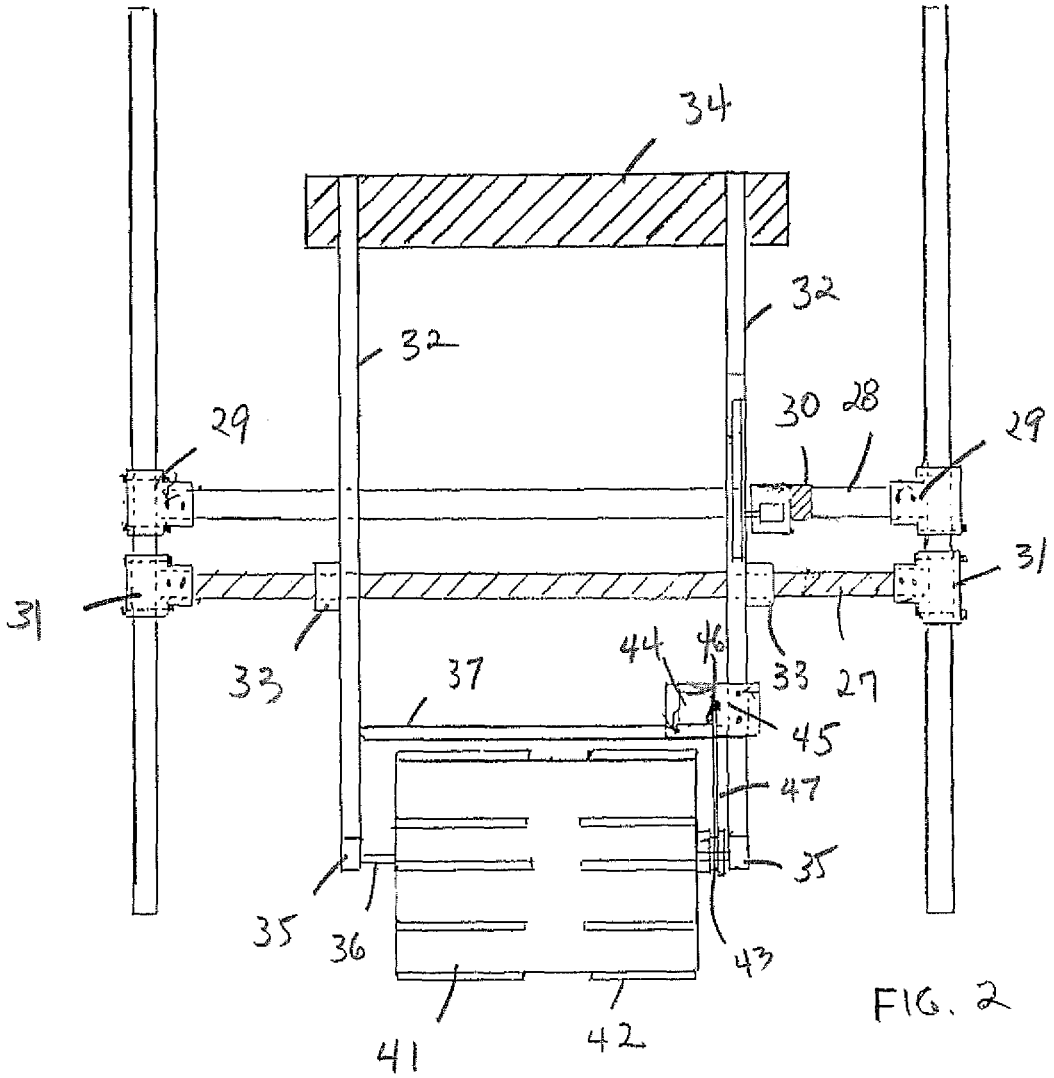
FIG. 2 is a partial top view of the roller assembly.
Figure 3:
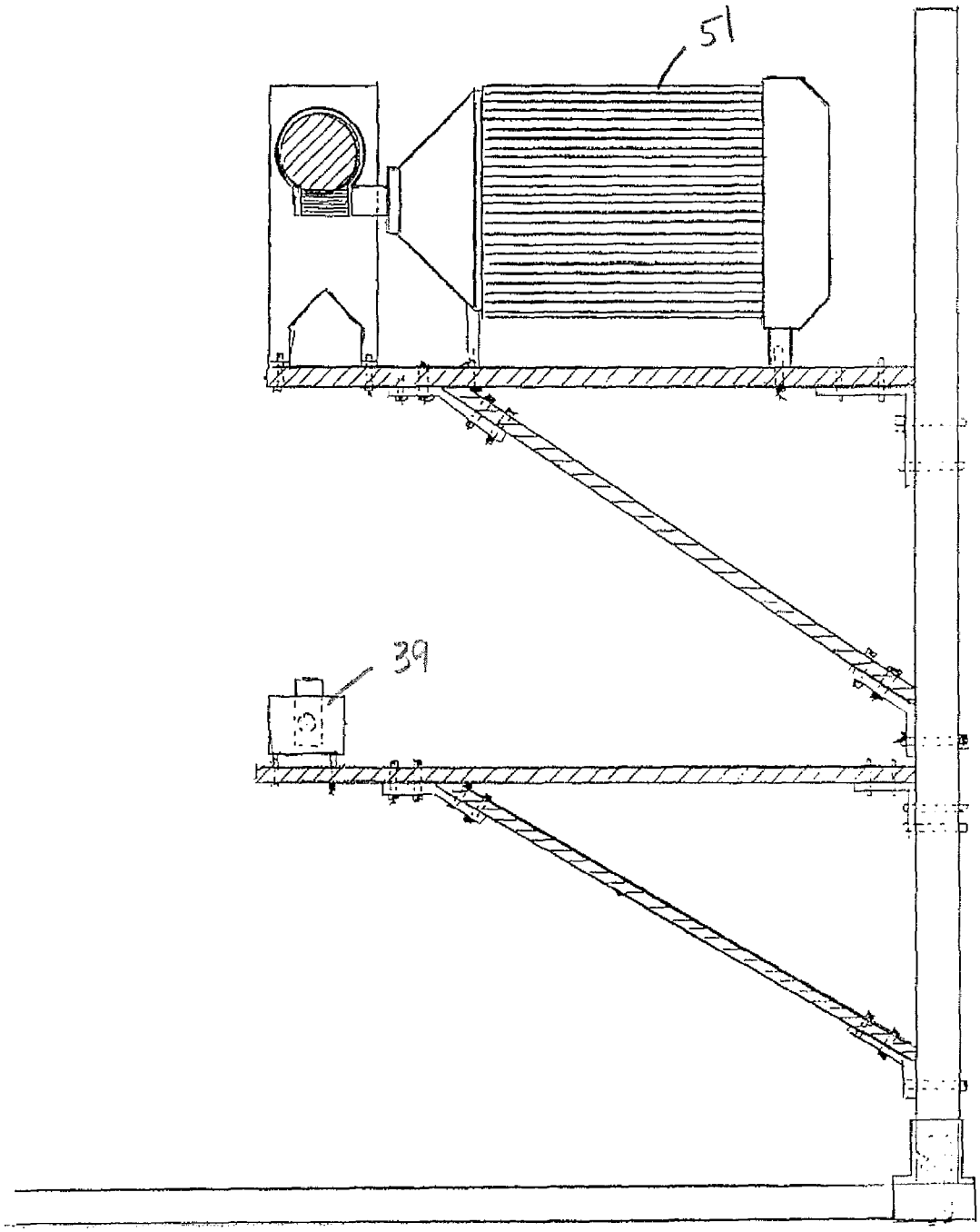
FIG. 3 is a front view of the roller assembly control system.
Figure 4:
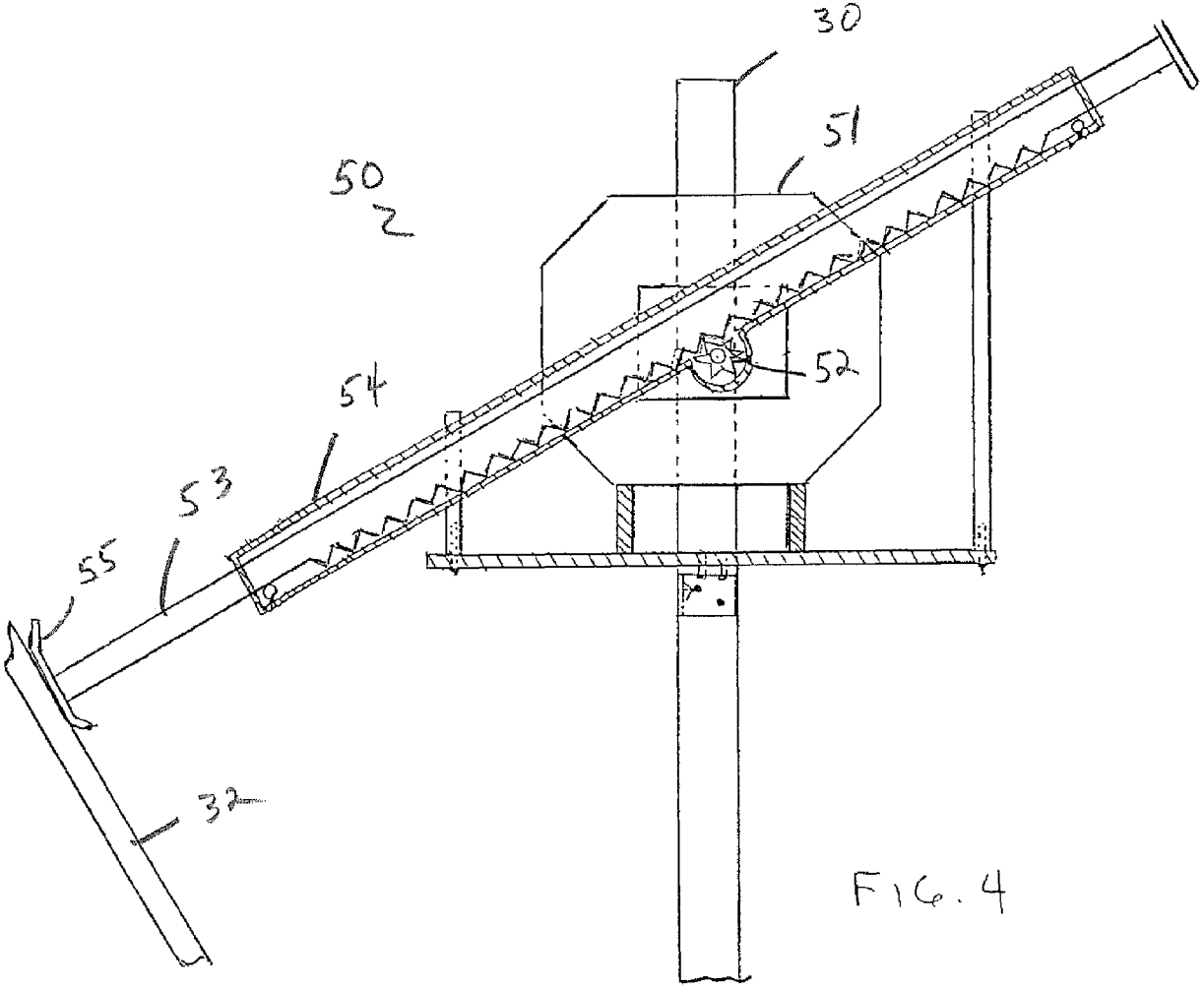
FIG. 4 is a front view, partly in section, of the push rod assembly.
Figure 5A:
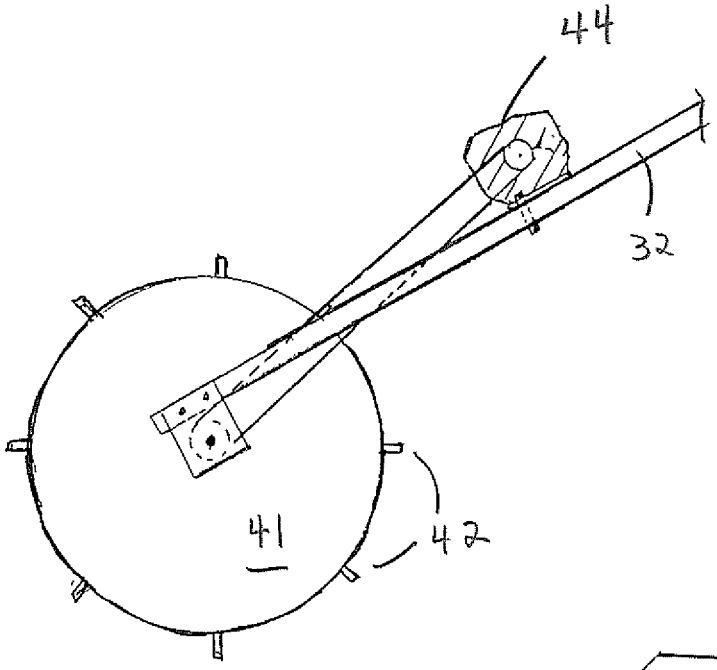
FIG. 5A is a side view of the roller and electrical drive.
Figure 5B:
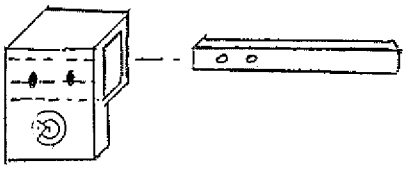
FIG. 5B is a side view of the wheel bearing housing.
Figure 5C:
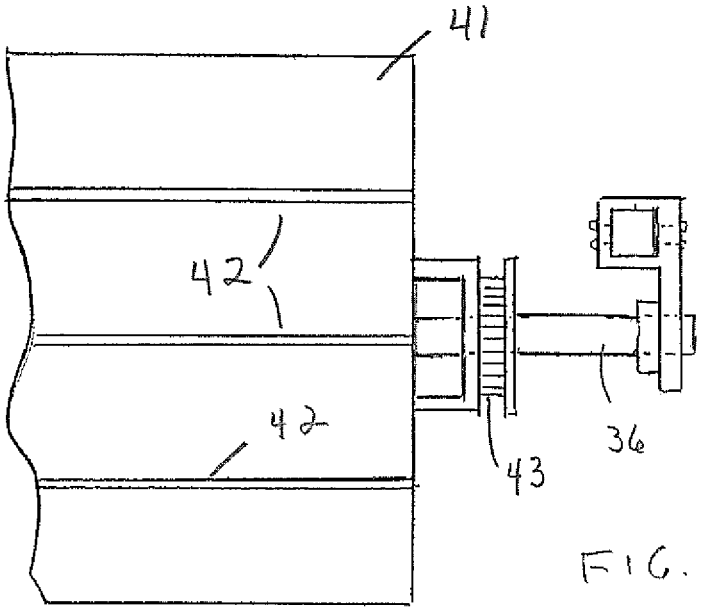
FIG. 5C is a front view, partly in section, of the roller.
Figure 6A:
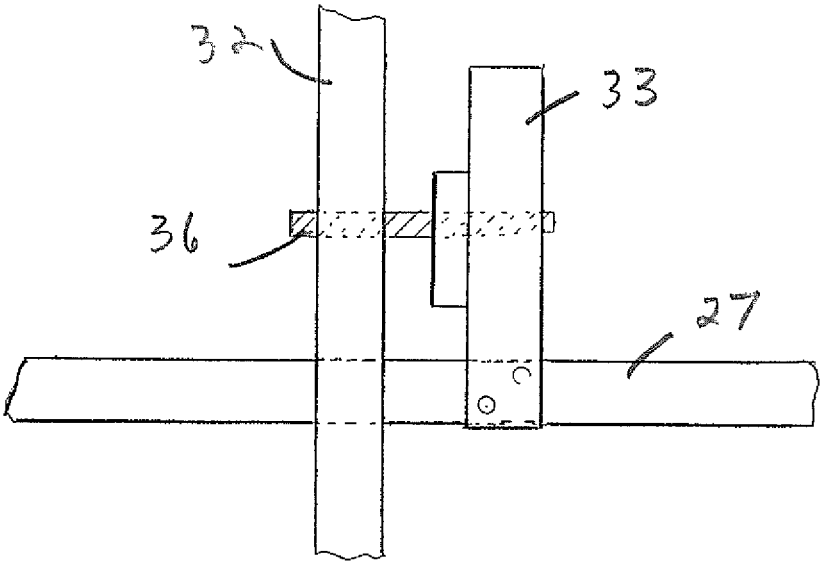
FIG. 6A is a front view, partly in section, of a swing arm.
Figure 6B:
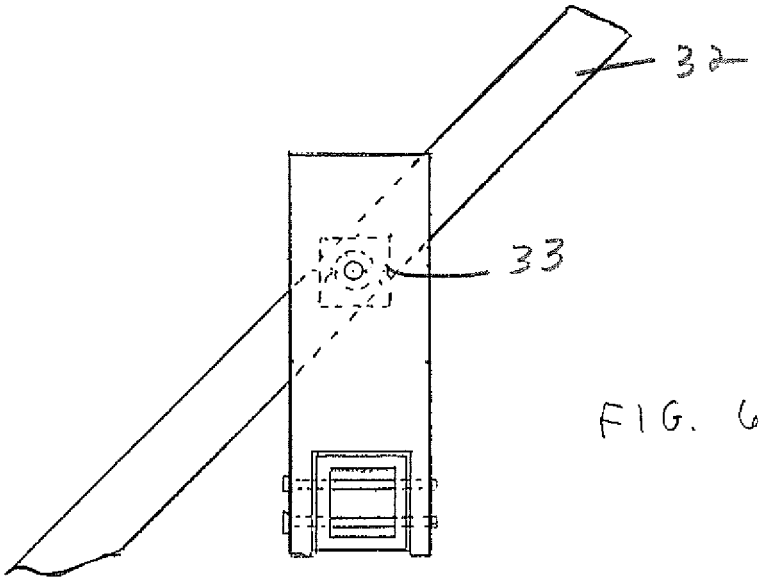
FIG. 6B is a side view of FIG. 6A.
Figure 7A:
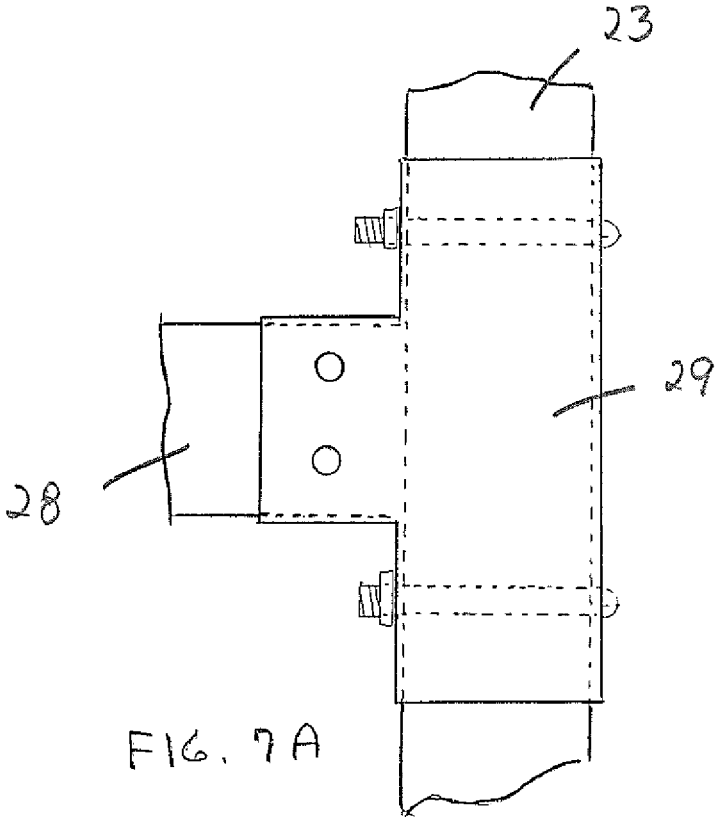
FIG. 7A is a top view of a frame junction
Figure 7B:
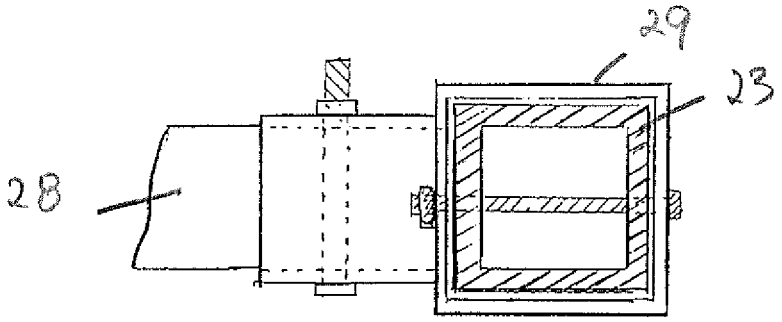
FIG. 7B is a side view of FIG. 7A.

Referring to the drawings in detail wherein like elements are indicated by like numerals, there is shown a roller apparatus 1 comprised of a frame 20 holding a roller assembly 40, said frame adapted to accommodate a dump truck 10 within the frame interior. The truck 10 has a front cab 11, a rear dump body 12, and a granular dispenser 13 within the dump body 12 and extending rearward from the dump body 12. The dispenser 13 is adapted to hold a supply of granular material 5 within a dispenser interior 16 and dispensing said granular material 5 out a dispenser rear 15. The dispenser 13 has a screen 14 attached to the top of the dispenser. Granular material is loaded into the dispenser interior 16 through said screen 14.

The frame 20 has a generally rectangular shape with a top 21, a bottom 22, two opposite, parallel sides 23, an open front 24, and an open rear 25, said front and rear defining a frame, longitudinal axis, said top, bottom, front, rear, and sides defining a frame interior 26. The frame top 21 includes a first top frame crossbeam 27 and a second parallel top frame cross-beam 28 in a spaced relationship with the first crossbeam, each crossbeam extending from side to side, and attached thereto. Each crossbeam 27, 28 has a longitudinal axis transverse to the frame longitudinal axis. The second crossbeam 28 lies between the first cross beam 27 and the frame rear 25. At a point spaced from one of the junctions 29 of the second crossbeam 28 with the frame sides 23, an elongated, vertical frame bar 30 extends directly upward from the second crossbeam 28, said vertical frame bar 30 having a longitudinal axis perpendicular to the frame longitudinal axis and second crossbeam longitudinal axis.

At points spaced from each junction 31 of the first crossbeam 27 with the frame sides 23, two elongated swing arms 32 are attached by means of first wheel bearing housings 33 to the first crossbeam 27. Each swing arm 32 jointly terminates at one end in a counter weight 34. Each swing arm 32 terminates at its other end in a second wheel bearing housing 35 jointly joined to a center roller bar 36. The swing arms 32 are braced with a swing arm cross bar 37 having a longitudinal axis transverse to the frame longitudinal axis. The swing arm cross bar 37 interconnects each swing arm 32 at parallel points between the first and second wheel bearing housings 33, 35. The swing arms 32 protrude through the frame top 21 wherein the arms terminate in said counterweights 34 positioned rearward of the first cross beam 27.

The roller assembly 40 is comprised of a roller 41 journaled to the center roll bar 36. The roller 41 has a plurality of horizontal, hard bristle, brush rows 42 attached thereto. One side of the roller 41 has a first rotary gear 43 fixedly attached thereto. A swing arm electric motor 44 is attached to a junction 45 formed by the swing arm cross bar 37 joined to a swing arm 32. The electric motor 44 drives a second rotary gear 46 linked by a drive chain 47 to the first rotary gear 43. In this embodiment of the invention, the roller 41 is adapted to being turned in a clockwise direction. The roller 41 is positioned within the frame interior 26 forward of the first crossbeam 27.

The vertical frame bar 30 has a sensor 39 attached thereto, said sensor 39 adapted to engage a swing arm 32 when the swing arm rotates near to said sensor 50. Above the sensor 39, a push rod assembly 50 is attached to said vertical frame bar 30. The push rod assembly 50 is comprised of a vertical frame electric motor 51 driving a rotary gear 52 attached thereto. The rotary gear 52 engages an elongated push rod 53 contained within a push rod housing 54 also attached to said vertical frame bar 30. The push rod 53 terminates at each end in a pressure plate 55. One of the pressure plates 55 is adapted to engage a swing arm 32. When the sensor 39 engages a swing arm 32, the sensor 39 activates the vertical frame electric motor 51 which the moves the push rod 53 and an attached pressure plate 55 against the swing arm 32 causing the swing arms 32 to pivot about the wheel bearing housings 33 causing the roller assembly 40 to swing upward to a preset position. A separate electrical switch 38 on the frame 20 reverses the action by the motor 51 on the push rod 53 thereby allowing the roller assembly 40 to swing downward.

In operation, the roller apparatus frame 20 is set up on a flat area convenient to a supply of material 5 such as sand or salt. The roller 41, in a pre-operation mode, is normally in an upward position. A truck 10 containing a dispenser 13 has material 5 loaded onto the dispenser screen 14. Because the material 5 is typically clumped and often frozen, much of the material 5 on the screen 14 does not enter the dispenser interior 16. The truck 10 is then driven to the frame rear 25 and into the frame interior 26 with the truck cab 11 just protruding out of the frame interior 16 through the frame front 24.

The truck operator then activates the electrical switch 38 thereby activating the roller assembly 40 and pivoting the roller 41 downwardly onto the material 5 on the dispenser screen 14. The activated roller electric motor 44 drives a second rotary gear 46 linked by a drive chain 47 to the first rotary gear 43, thereby turning the roller 41 in a clockwise direction. The roller bristle brushes 42 scrape the material 5 forcing much of it through the screen 14 into the dispenser interior 16 and the remainder material off the screen 14. The truck driver slowly drives the truck 10 through the frame interior 26 out the frame front 24. This enables the roller 41 to act on all of the material 5 on the dispenser screen 14. When the truck 10 exits the frame interior 26, the roller 41 pivots further downwardly. As the roller 41 moves downwardly, one of the roller assembly swing arms 32 engages the vertical frame bar sensor 39 thereby activating the vertical frame electric motor. This action moves the push rod 53 and an attached pressure plate 55 against the swing arm 32 causing the swing arms 32 to pivot about the wheel bearing housings 33 causing the roller assembly 40 to swing upward to a present position.

Since the truck dispenser interior 16 is usually not filled with screened material during the initial pass through the frame 20, the truck dispenser 13 has additional material 5 loaded onto the dispenser screen 14. The process of going through the frame interior 26 and having the roller assembly 40 act on the material 5 is repeated. Usually two passes is enough, although the process may be repeated as many times as necessary to fill the dispenser interior 16 with screened material.

It is understood that the above-described embodiment is merely illustrative of the application. Other embodiments may be readily devised by those skilled in the art which will embody the principles of the invention and fall within the spirit and scope thereof.

I claim:

1. A roller apparatus adapted to clear a screen on a granular dispenser sitting within a dump truck body, comprising:

a frame adapted to accommodate a dump truck within a frame interior, said dump truck having a front cab, a rear dump truck body, and a granular dispenser within the rear dump truck body and extending rearward from the rear dump truck body, said granular dispenser adapted to hold a supply of granular material within a dispenser interior and dispensing said granular material out a granular dispenser rear, said granular dispenser having a screen attached to an open top of the granular dispenser, said granular material loaded into the dispenser interior through said screen;

wherein the frame has a generally rectangular shape with a top, a bottom, two opposite, parallel sides, an open front, and an open rear, said front and rear defining a frame, longitudinal axis, said top, bottom, front, rear, and sides defining a frame interior, said frame top having a first top frame crossbeam and a second parallel top frame crossbeam in a spaced relationship with the first crossbeam, each crossbeam extending from side to side, and attached thereto, each said crossbeam having a longitudinal axis transverse to the frame longitudinal axis, said second crossbeam laying between the first cross beam and the frame rear;

wherein at a point spaced from one of the junctions of the second crossbeam with the frame sides, an elongated, vertical frame bar extends directly upward from the second crossbeam, said vertical frame bar having a longitudinal axis perpendicular to the frame longitudinal axis and second crossbeam longitudinal axis;

two elongated swing arms, each having two opposite ends, attached by means of first wheel bearing housings to the first crossbeam at points spaced from each junction of the first crossbeam with the frame sides, each said swing arm jointly terminating at one end in a counter weight, each said swing arm terminating at its other end in a second wheel bearing housing jointly joined to a center roller bar, said swing arms braced with a swing arm cross bar having a longitudinal axis transverse to the frame longitudinal axis, said swing arm cross bar interconnecting each swing arm at parallel points between the first and second wheel bearing housings, said swing arms protruding through the frame top wherein the swing arms terminate in said counterweights positioned rearward of the first cross beam;

a roller assembly held by said frame, said roller assembly comprised of a roller journaled to the center roll bar, said roller having a plurality of horizontal, hard bristle, brush rows attached thereto, said roller having a side;

wherein the roller is positioned within the frame interior forward of the first crossbeam.

2. A roller apparatus as recited in claim 1, further comprising:

a first rotary gear attached to a side of the roller;

a swing arm electric motor attached to a junction formed by the swing arm cross bar joined to a swing arm, said electric motor driving a second rotary gear linked by a drive chain to the first rotary gear.

3. A roller apparatus as recited in claim 2, further comprising:

a sensor attached to the vertical frame bar, said sensor adapted to engage a said swing arm when the swing arm rotates near to said sensor;

a push rod assembly attached to said vertical frame bar above the sensor, said push rod assembly comprised of a vertical frame electric motor driving a rotary gear attached thereto, said rotary gear engaging an elongated push rod contained within a push rod housing attached to said vertical frame bar, said push rod terminating at each end in a pressure plate, wherein one of the pressure plates is adapted to engage a swing arm, wherein when the sensor engages a swing arm, the sensor activates the vertical frame electric motor thereby moving the push rod and an attached pressure plate against the swing arm causing the swing arms to pivot about the wheel bearing housings causing the roller assembly to swing upward to a preset position;

a separate electrical switch on the frame adapted to reverse the action by the vertical frame electric motor on the push rod thereby allowing the roller assembly to swing downward.

* * * * *